US006991345B2

(12) United States Patent
Helenowski

(10) Patent No.: US 6,991,345 B2
(45) Date of Patent: Jan. 31, 2006

(54) PORTABLE LIGHT SOURCE WITH MIRROR

(76) Inventor: Jacek Helenowski, 4300 W. North Ave., Stone Park, IL (US) 60165

( * ) Notice: Subject to any disclaimer, the term of this patent is extended or adjusted under 35 U.S.C. 154(b) by 0 days.

(21) Appl. No.: 10/741,085

(22) Filed: Dec. 20, 2003

(65) Prior Publication Data

US 2005/0135088 A1 Jun. 23, 2005

(51) Int. Cl.
*F21V 33/00* (2006.01)

(52) U.S. Cl. ..... 362/137; 362/155

(58) Field of Classification Search ..... 362/135–137, 362/154–156

See application file for complete search history.

(56) References Cited

U.S. PATENT DOCUMENTS

| | | | | | |
|---|---|---|---|---|---|
| 1,496,575 | A * | 6/1924 | Hanna | 362/136 |
| 1,742,958 | A * | 1/1930 | Kaufman | 362/137 |
| 1,875,650 | A * | 9/1932 | Pemberton et al. | 362/136 |
| 2,094,006 | A * | 9/1937 | O'Moore-Farrell | 132/318 |
| 2,185,149 | A * | 12/1939 | Hallbauer | 362/156 |
| 2,258,542 | A * | 10/1941 | Cressaty | 362/137 |
| 2,269,750 | A * | 1/1942 | Baird | 362/119 |
| 2,494,375 | A * | 1/1950 | Bates et al. | 132/288 |
| 2,512,476 | A * | 6/1950 | Birnkrant et al. | 132/316 |
| 2,651,709 | A * | 9/1953 | Ross et al. | 362/577 |
| 2,678,955 | A * | 5/1954 | Miller | 362/136 |
| 2,779,344 | A * | 1/1957 | Hemmings et al. | 132/288 |
| 3,163,364 | A * | 12/1964 | Ritter et al. | 362/137 |
| 3,619,596 | A * | 11/1971 | Jackson | 362/156 |
| 3,714,411 | A * | 1/1973 | Waters et al. | 362/137 |
| 3,937,320 | A * | 2/1976 | Chao et al. | 206/216 |
| 4,126,145 | A * | 11/1978 | Boyd | 132/288 |
| 4,888,667 | A * | 12/1989 | Hwang | 362/109 |
| 4,905,128 | A * | 2/1990 | Caires | 362/109 |
| 5,025,354 | A * | 6/1991 | Kondo | 362/135 |
| 5,034,658 | A * | 7/1991 | Hierig et al. | 315/76 |
| 5,036,441 | A * | 7/1991 | Herron | 362/95 |
| 5,688,037 | A * | 11/1997 | Chen | 362/98 |
| 5,983,905 | A * | 11/1999 | Patching | 132/318 |
| 6,224,236 | B1 * | 5/2001 | Shu | 362/205 |
| 6,789,972 | B2 * | 9/2004 | Nadel | 401/195 |
| 2002/0002758 | A1 * | 1/2002 | Stura et al. | 16/287 |

* cited by examiner

*Primary Examiner*—Stephen Husar
*Assistant Examiner*—Jason Han
(74) *Attorney, Agent, or Firm*—Susan L. Lukasik

(57) ABSTRACT

A light source is disposed in a cosmetic housing. One or more mirrors are disposed between the cosmetic housing and a cover that opens to expose the mirror(s). The light source is manually or automatically activated. The light source is activatable over any angle between the cover and the rest of the housing, thus an angle for turning on the light source is selectable.

22 Claims, 5 Drawing Sheets

PORTABLE LIGHT SOURCE WITH MIRROR

FIELD OF THE INVENTION

This invention relates to illumination, including, but not limited to, illumination sources disposed in portable housings, for example, cosmetic housings.

BACKGROUND OF THE INVENTION

Cosmetics come in various different types, such as lipstick, mascara, eyeliner, and so forth. In order to apply cosmetics, one needs to see the area on which the cosmetic is to be applied. Often a mirror is utilized to apply cosmetics to oneself, but carrying a mirror can be inconvenient, especially when it is dark and one needs to dig in one's purse, bag, or knapsack to find the mirror.

Accordingly, there is a need for an apparatus that more conveniently facilitates the application of cosmetics.

DESCRIPTION OF A PREFERRED EMBODIMENT

The following describes a cosmetic housing that includes one or more mirrors and a light source. The mirror(s) are protected by a rotatable cover that protects the mirror(s) when closed and when opened to a certain point, activates the light source to facilitate convenient application of cosmetics in any lighting conditions. The cover also protects the light source.

Figure 1:
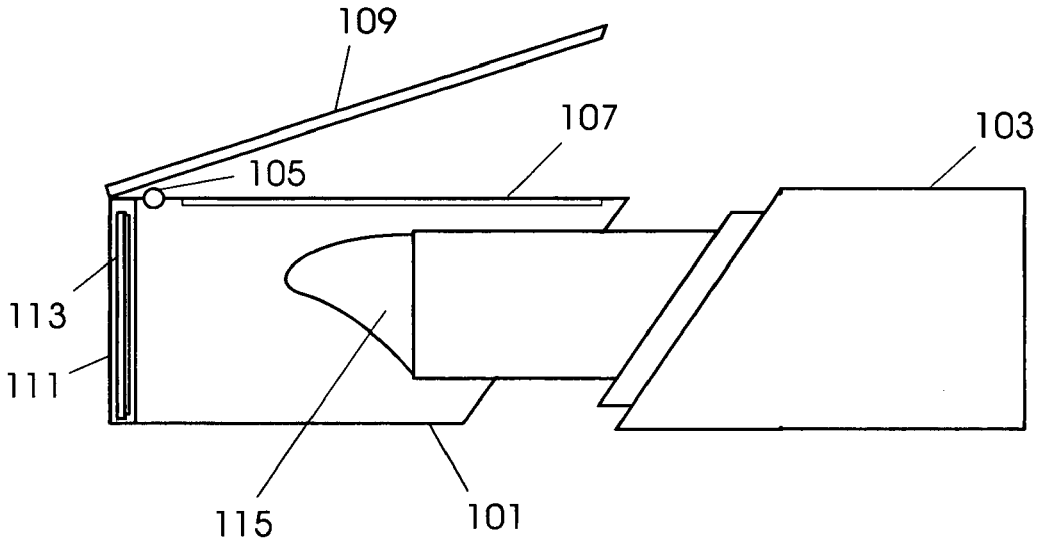
FIG. 1 is a partial cross-sectional view of a cosmetic housing with a light source, a cover partially open, and a mirror in accordance with the invention.

A partial cross-sectional view of a cosmetic housing with a light source, a cover partially open, and a mirror is shown in FIG. 1. A cap 101 and a base 103 form a cosmetic housing. A light source 105 is at least partially disposed in the cap 101. The light source 105 may be one or more light emitting diodes (LEDs), a plasma light source, an electroluminescent light source, and so forth, or any combination thereof. The light source 105 may be a single elongated bulb or a plurality of bulbs or LEDs. The light source 105 may provide one or more different colors, such as may be provided by bulbs of different colors, and/or the light source 105 may provide a variety of different lighting levels, such as may be provided by a dimmer switch. A light source 105 that is energy efficient by nature also provides advantage.

A mirror 107 is shown disposed on a part of an outer surface of the cap 101. A cover 109 is rotatable to open and close to expose the mirror 107 and the light emitted by the light source 105. A removable covering 111, such as a threaded or pryable lid, is optionally provided near a battery 113 that powers the light source 105 to allow for replacement of the battery 113.

A cosmetic 115, such as lipstick, mascara, eyeliner, and so forth, is disposed within the cosmetic housing. Although FIG. 1 shows the cosmetic 115 attached to the base 103 and the mirror 107 and light source 105 disposed on the cap 101, the cosmetic 115 need not be disposed in the base 103, and the mirror 107 and/or light source 105 may be disposed on the base 103.

Figure 2:
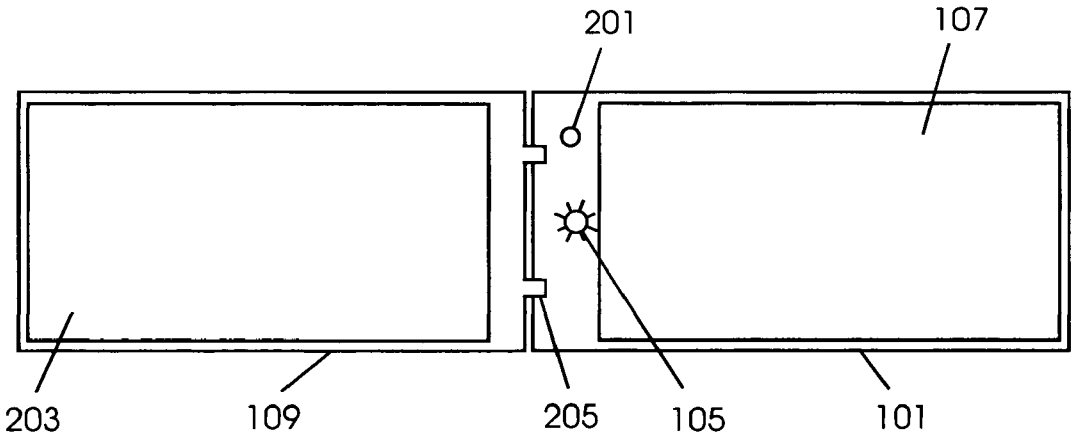
FIG. 2 is a view of a part of the cosmetic housing with the cover open and illustrating the light source and mirror in accordance with the invention.

A view of a part of the cosmetic housing with the cover in an open position and illustrating the light source and mirror(s) is shown in FIG. 2. A switch 201 for the light source 105 is shown as extending away from the cap 101 when the cover 109 is open. The switch 201 may be, for example, a spring-loaded switch that activates the light source 105 when the cover 109 is opened at least part of the way between a closed position and a fully open position. The switch 201 may operate in a similar way as the switch operates to turn on a refrigerator light when its door opens. Alternatively, the switch may be integrated into the housing of the light source 105. For example, the light source 105 may be incorporated with a spring-loaded switch, for example making the light source 105 spring-loaded, such that a circuit (see FIG. 4) is closed when the cover 109 is opened at least part of the way between a closed position and a fully open position, and the light source 105 is activated. The switch 201 may be a manually-activated switch.

A mirror 107 may be disposed on the outer surface of the cap 101 and/or a mirror 203 may be disposed on the inner surface of the cover 109. Thus, one or more mirrors 107 and 203 may be disposed between the cap 101 and the cover 109. The mirrors 107 and 203 may advantageously be recessed into the cap 101 and/or the cover 109. The mirror(s) 107 and 203 may be comprised of tempered or shatter-resistant glass or safety glass or plastic.

A hinge 205 is shown coupling the cover 109 to the cap 101, as well as providing for a rotatable connection that facilitates the opening and closing of the cover 109. The hinge 205 may be integrated into the cover 109 to the cap 101 during molding, or added as a separate device after molding. A hinge pin may be part of the hinge. The light source 105 and/or switch 201 are advantageously disposed near the hinge 205 for additional protection of these devices. A gasket (not shown), such as an elastomeric, rubber, or other type of sealing material, may be disposed between the light source 105 and the cap 101 to provide resistance to moisture.

Figure 3:
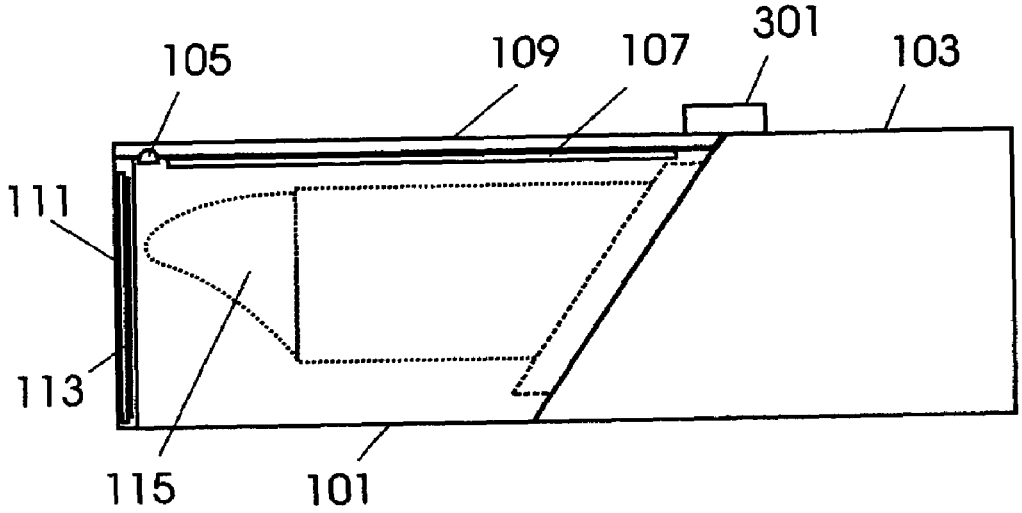
FIG. 3 is a cross-sectional view of the cosmetic housing with the cover closed in accordance with the invention.

A cross-sectional view of the cosmetic housing with the cover closed is shown in FIG. 3. An optional clasp 301 is shown holding the cover 109 to the base 103 to aid in protecting the mirror(s) 107 and 203 and light source 105 when not in use. The clasp 301 may optionally hold the cover 109 to the cap 101. The clasp 301 may be a flexible material, such as plastic, that facilitates opening of the cover 109. The clasp 301 may be molded when the housing is molded or it may be a separate piece attached after molding. The cover 109 may contain a recess to provide space for the light source when the cover 109 is closed.

Figure 4:
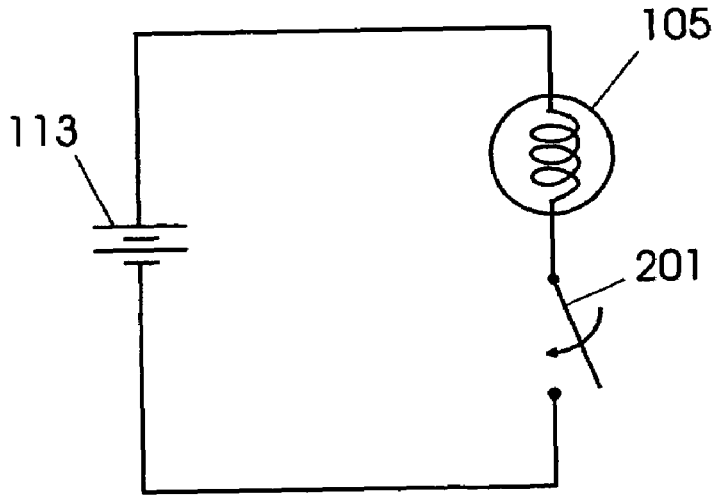
FIG. 4 is an electrical diagram for the light source in accordance with the invention.

An electrical diagram for the light source is shown in FIG. 4. The battery 113 powers the light source 105 when the switch 201 is closed. The battery 113 is appropriately orientated to illuminate the light source 105, as known in the art. When the switch 201 is open, the light source 105 is not activated.

Figure 5:
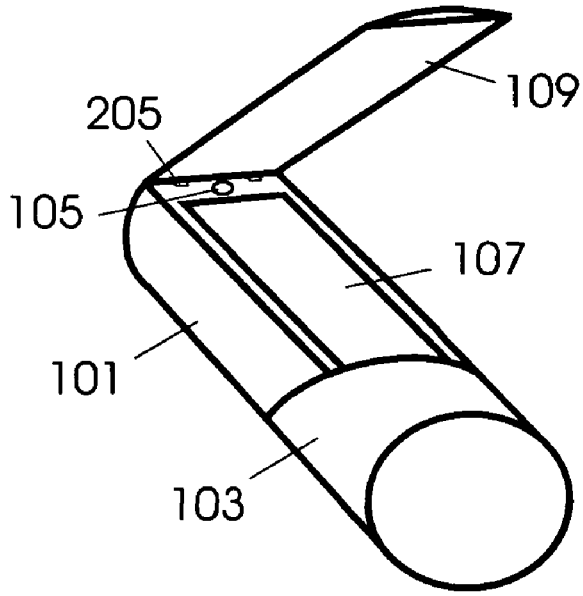
FIG. 5 and FIG. 6 are perspective views of the cosmetic housing in accordance with the invention.
Figure 6:
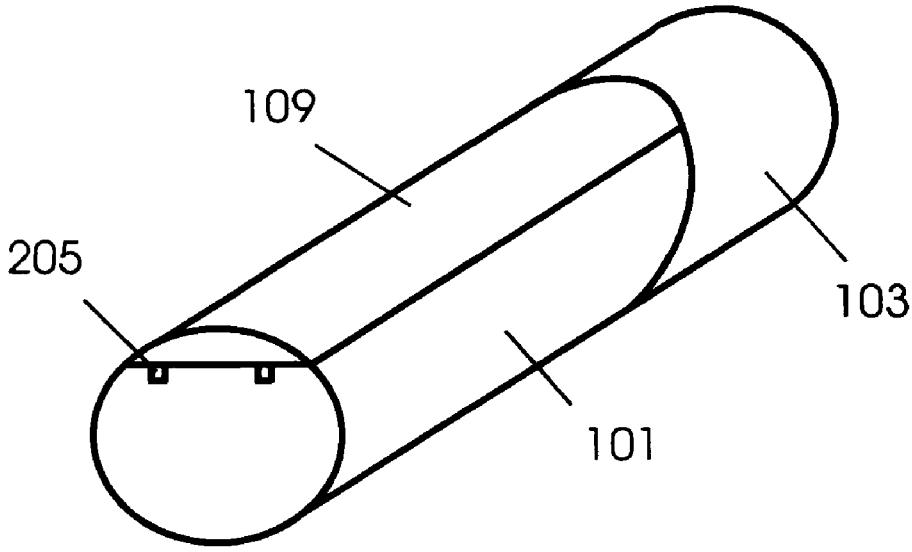
Figure 7:
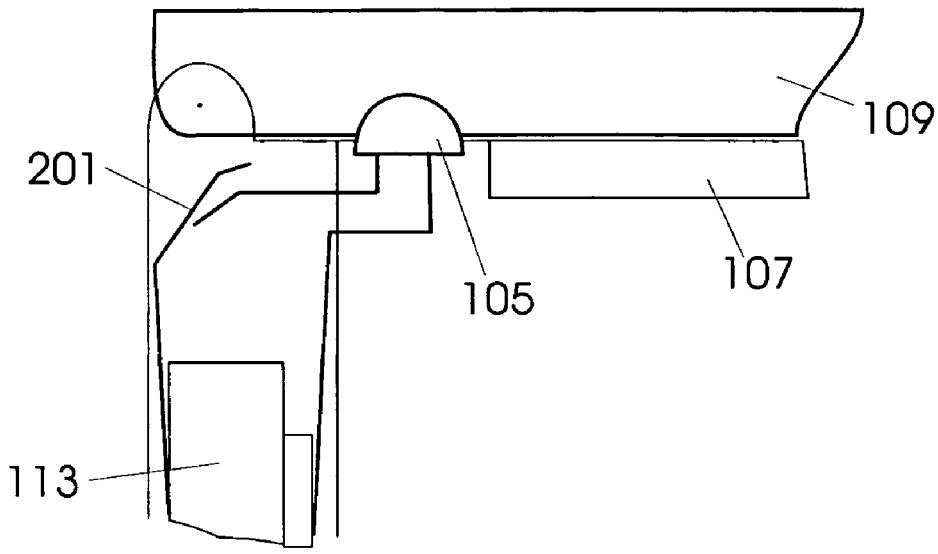
FIG. 7, FIG. 8, FIG. 9, and FIG. 10 show optional various switching mechanisms for the cosmetic housing in accordance with the invention.
Figure 8:
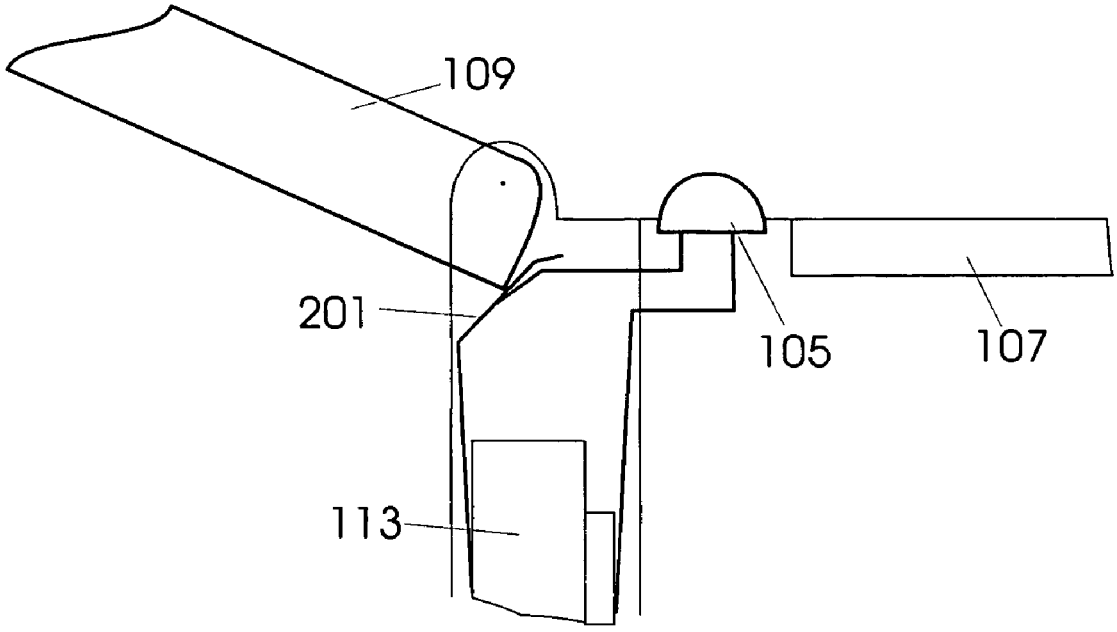

Perspective views of the cosmetic housing are shown in FIG. 5 and FIG. 6. FIG. 5 illustrates an option with an internal switch. Various different internal switches may be utilized, including a spring-loaded switch. Another type of switch is shown in FIG. 7 and FIG. 8, whereby the switch 201 comprises a flexible electrical conductor that makes no contact with the circuit containing the light source 105 when the cover 109 is closed as shown in FIG. 7, but when the cover 109 is open to a certain point, the flexible electrical conductor makes contact with the circuit containing the light source 105, which is then illuminated. The flexible electrical conductor may be arranged to change the angle between the cover 109 and the mirror 107 or cap 101 at which angle the light source 105 illuminates.

Figure 9:
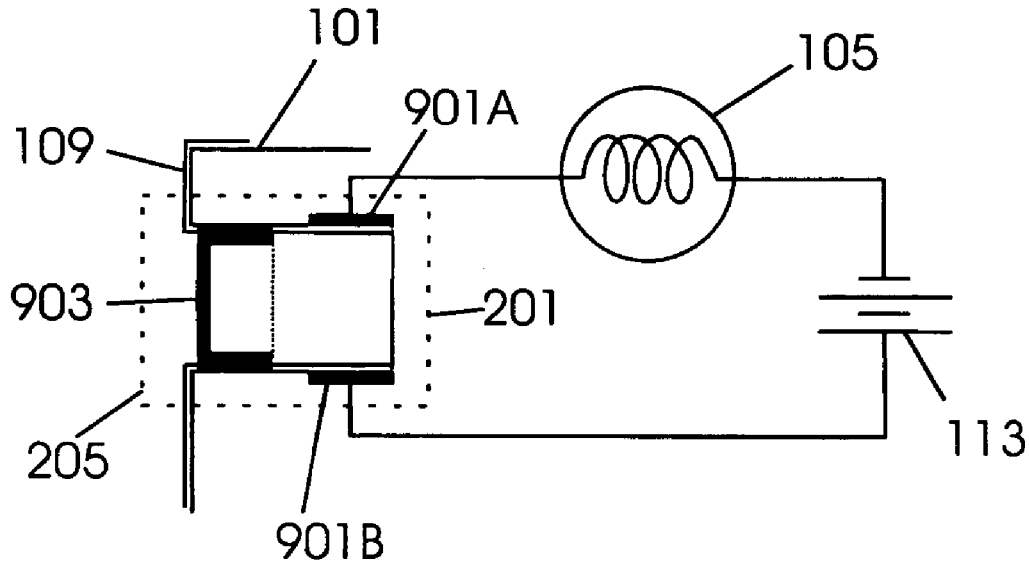
Figure 10:
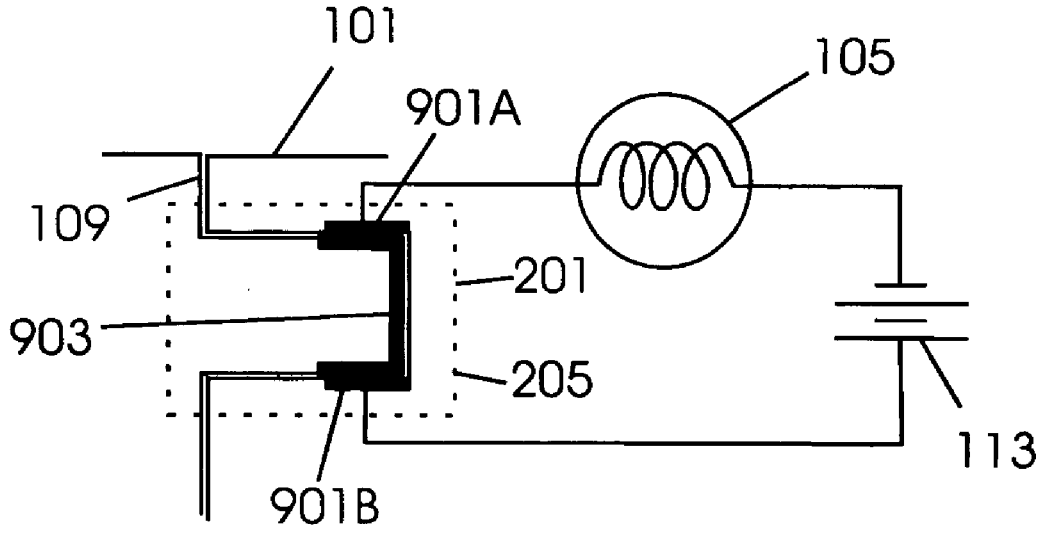

Another option for a switching mechanism for the cosmetic housing is shown in FIG. 9 and FIG. 10. In this embodiment, the switch 201 is implemented as electrical conductors disposed on or embedded in a hinge 205. Part of the hinge 205 of the cap 101 has an electrical conductor 901A disposed on or embedded on one side, which electrical conductor 901A is electrically connected to one end of the light source 105. An opposing part of the hinge 205 of the cap 101 has an electrical conductor 901B disposed on or embedded on one side, which electrical conductor 901B is electrically connected to one end of the battery 113. The other end of the light source 105 is connected to the other end of the battery 113. A part of the hinge 205 of the cover 109 has an electrical conductor 903 disposed along a part of the hinge 205, such that when the cover 109 is closed, the electrical conductors 901A, 901B, and 903 are not electrically connected and the light source 105 remains off, and when the cover 109 opens to a certain angle with respect to the mirror 107 or cap 101, the electrical conductors 901A and 901B make contact with the electrical conductor 903, and the light source 105 is activated. By modifying how much coverage and/or the location of the electrical conductors 901A, 901B, and 903 on the various parts of the hinge 205, the angle between the cover 109 and the mirror 107 or base 103 at which the light source 105 is activated varies. The angle may be between almost 0 degrees and a fully open cover 109 with respect to the mirror 107 or cap 101.

The present invention provides a cosmetic housing that provides one or more mirrors and a light source. A rotatable cover protects the mirror(s) and light source when closed. The cover automatically turns off the light source when closed, and activates the light source when opened a predetermined part of its travel. Automatic and manual activation of the light source is provided. The mirror and light are maintained separately from the cosmetic to keep the cosmetic from fouling them. The invention provides for a convenient way to apply cosmetics without having to carry a separate cosmetic, mirror, and light source.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A cosmetic housing comprising:

a first member that is elongated and has a compartment disposed at one end;

a second member operably couplable with the first member, such that a cosmetic is enclosed between the first member and the second member;

a cover having a first end operably couplable outside the first member, such that the cover is rotatable;

a light source at least partially disposed between the cover and the first member and activated by opening the cover;

a switch and a power source for the light source disposed in the compartment;

at least one mirror disposed between the cover and the first member.

2. The cosmetic housing of claim 1, further comprising a switch disposed between the cover and the first member, and arranged to activate the light source.

3. The cosmetic housing of claim 2, wherein the switch is integrated with the light source.

4. The cosmetic housing of claim 2, wherein the switch is spring loaded.

5. The cosmetic housing of claim 1, wherein the light source is activated when the cover is opened at least part of the way between a closed position and a fully open position.

6. The cosmetic housing of claim 1, wherein the cover has a surface that at least partially mates with a surface of the first member when the cover is closed.

7. The cosmetic housing of claim 1, further comprising a clasp arranged and constructed to hold the cover to the first member when the cover is in a closed position and to facilitate opening of the cover.

8. The cosmetic housing of claim 1, wherein the at least one mirror is disposed on at least one of the first member and the cover.

9. The cosmetic housing of claim 1, wherein at least one of the at least one mirror and the light source is recessed into the first member.

10. The cosmetic housing of claim 1, wherein the light source is disposed externally to a cosmetic disposed within the cosmetic housing.

11. The cosmetic housing of claim 1, further comprising a removable covering that houses a battery to power the light source.

12. The cosmetic housing of claim 1, wherein the cover is rotatable with respect to the first member by a hinge that is partially integrated in the cover and partially integrated in the first member.

13. The cosmetic housing of claim 1, wherein the light source is comprised of at least one of a light emitting diode, a plasma light source, and an electroluminescent light source.

14. The cosmetic housing of claim 1, further comprising a switch comprised of a flexible electrical conductor that activates the light source when the cover is open to an angle between the cover and the first member.

15. The cosmetic housing of claim 1, further comprising a switch comprised of a plurality of electrical conductors disposed on a hinge connecting the cover and the first member, wherein a first part of the hinge comprises a first electrical conductor and is a part of the cover; wherein a second part of the hinge comprises a second electrical conductor and is part of the first member; and wherein the switch is closed when the first electrical conductor contacts the second electrical conductor.

16. A cosmetic housing comprising:

a first member that is elongated;

a second member operably couplable with the first member, such that a cosmetic is enclosed between the first member and the second member;

a cover having a first end operably couplable outside the first member, such that the cover is rotatable;

a light source at least partially disposed between the cover and the first member and activated by opening the cover;

at least one mirror disposed between the cover and the first member;

a power source and a switch are disposed in the first member.

17. A cosmetic housing comprising:

a first member having a power source disposed at a first end;

a second member operably couplable with the first member, such that a cosmetic is enclosed between the first member and the second member;

a cover having a first end operably couplable to the first member, such that the cover is rotatable;

a light source that is at least partially disposed within the first member and is actuatable when the first end of the cover engages a switch disposed at the first end of the first member;

at least one mirror disposed on the first member and between the cover and the first member.

18. The cosmetic housing of claim 17, wherein the switch comprises a plurality of electrical conductors disposed on a hinge connecting the cover and the first member; wherein the switch is closed with the cover and the first member are in a first position and the switch is open when the cover and the first member are in a second position.

19. The cosmetic housing of claim 17, further comprising a clasp arranged and constructed to hold the cover to the first member when the cover is in a closed position and to facilitate opening of the cover.

20. The cosmetic housing of claim 17, wherein the at least one mirror is disposed on at least one of the first member and the cover.

21. The cosmetic housing of claim 17, wherein at least one of the at least one mirror and the light source is recessed into the first member.

22. The cosmetic housing of claim 17, wherein the cover is rotatable with respect to the first member at the first end of the cover and the switch comprises a flexible electrical conductor disposed inside the first member.

* * * * *